US009145191B2

(12) United States Patent
Löfgren et al.

(10) Patent No.: US 9,145,191 B2
(45) Date of Patent: Sep. 29, 2015

(54) METHOD AND DEVICE FOR AVERTING AND DAMPING ROLLING OF A SHIP

(75) Inventors: Arne Löfgren, Västerås (SE); Tomas Lindqvist, Västerås (SE); George Fodor, Västerås (SE)

(73) Assignee: Q-TAGG R&D AB, Västerås (SE)

( * ) Notice: Subject to any disclaimer, the term of this patent is extended or adjusted under 35 U.S.C. 154(b) by 20 days.

(21) Appl. No.: 14/211,547

(22) PCT Filed: Sep. 11, 2012

(86) PCT No.: PCT/SE2012/050955

§ 371 (c)(1), (2), (4) Date: Mar. 14, 2014

(87) PCT Pub. No.: WO2013/039445

PCT Pub. Date: Mar. 21, 2013

(65) Prior Publication Data

US 2014/0316620 A1 Oct. 23, 2014

(30) Foreign Application Priority Data

Sep. 16, 2011 (SE) ..... 1130084

(51) Int. Cl.
*B63B 39/00* (2006.01)

(52) U.S. Cl.
CPC ..... *B63B 39/00* (2013.01)

(58) Field of Classification Search
CPC ..... B63B 39/00
USPC ..... 701/21
See application file for complete search history.

(56) References Cited

U.S. PATENT DOCUMENTS

| | | | | |
|---|---|---|---|---|
| 1,774,825 | A * | 9/1930 | Dow | 114/122 |
| 1,821,242 | A * | 9/1931 | Spencer | 445/56 |
| 3,683,837 | A * | 8/1972 | Polouektoff et al. | 114/125 |
| 6,978,728 | B2 * | 12/2005 | Koop et al. | 114/126 |
| 2008/0183341 | A1 * | 7/2008 | Neu et al. | 701/1 |

FOREIGN PATENT DOCUMENTS

| | | | |
|---|---|---|---|
| DE | 10355052 | B4 | 2/2005 |
| EP | 0423901 | A1 | 4/1991 |
| WO | 2010/118752 | A1 | 10/2010 |
| WO | 2011/034435 | A1 | 3/2011 |

* cited by examiner

*Primary Examiner* — Mary Cheung
*Assistant Examiner* — Frederick Brushaber
(74) *Attorney, Agent, or Firm* — Dilworth & Barrese, LLP

(57) ABSTRACT

This invention relates to a method and a device for averting and damping rolling of an engine-driven marine vessel with propeller propulsion. The proposed method recognizes the fact that the speed controller of a ship responds to heel angle variations by propeller speed adjustments. A speed controller is reading such propeller moment change as speed variations to be corrected. By the recurrence of this process, the result is amplifying small rolling effects to a critical rolling. Further elements contribute to this process, such as the propeller side effects ship's hull contact with the sea, waves or winds. However, by suppressing the interaction between heel angle variations and the speed controller, the rolling of a ship can be effectively reduced and averted. The proposed method, by suppressing the cause of the critical rolling, reduces rolling, fuel consumption and maintenance of the ship's propulsion engines.

19 Claims, 10 Drawing Sheets

LEGEND
M = Metacenter
G = Center of gravity
GM = Metacentric height
GZ = Righting arm
w = Weight
b = Buoyancy
θ = Heel angle

METHOD AND DEVICE FOR AVERTING AND DAMPING ROLLING OF A SHIP

TECHNICAL FIELD

This invention relates to a method and a device for averting and damping rolling of an engine-driven marine vessel with propeller propulsion.

BACKGROUND

Rolling of ships is a well-known risk to ship's safety. It can lead to loss of containers, high stress on the cargo securing system and discomfort for passengers and crew. Rolling of a ship can be described as the periodic movement of a pendulum. The corresponding time period is called the "natural rolling period" of a ship. When a ship is tilted e.g. by a sea wave, the centre of buoyancy of the ship moves laterally and a restoring moment is created which re-stabilizes the ship. Most often, the pendulum-type of rolling will dampen quickly due to the restoring moment and due to friction forces between the ship's hull and water. Rolling may be triggered by environmental disturbances such as waves, wind or sea currents. In some cases, disturbances can have very low energy and still develop successively into a high-amplitude rolling by an energy transfer mechanism between two states. For example a known dangerous variant of a critical rolling is the so called "parametric rolling", emerging when sea waves along the ship have a period that matches in a certain relation a ship's natural period.

A rolling with maintained amplitude and constant period is called a "critical rolling".

Historically, different types of devices have been proposed to reduce rolling, such as bilge keels, film stabilizers or rudder movements. However, rolling is still a major problem for ship navigation.

BRIEF DESCRIPTION OF DRAWINGS

For better understanding of the described method, reference will be made to the following figures.

PRIOR ART

The following prior-art is referred to in this document: (PA1): anti-rolling methods and devices, (PA2): engine speed and load control devices.

PA1—Anti-Rolling Methods and Devices (Prior Art)

Passive anti-rolling devices such as bilge keels are using friction energy to dissipate the rolling energy of a ship. Active anti-rolling devices are more effective than passive devices due to specialized actuators manipulated by controllers that inject energy to counteract rolling forces. Often used contemporary anti-rolling actuators are fin stabilizers.

An automated rolling reduction method is presented by the US patent of H. H. Dow U.S. Pat. No. 1,731,236, Oct. 15, 1929 and U.S. Pat. No. 1,774,825 Sep. 2, 1930 (the Dow patents). The Dow patents describe the use of a propeller or two propellers as anti-rolling actuators by counterbalancing the heel angle of a ship using the moment of one propeller or the resulting moment created between two propellers. Furthermore, the patent describes a mechanical setup for this compensation, an embodiment of a control system realized with the technology of 1930s.

Two patents that describe active anti-rolling devices are the European patent PA0423901A1 and the US patent US20080183341A1. The first uses as anti-rolling actuators the propulsion machinery of the ship consisting of controllable water jet engines and the later uses as anti-rolling actuators the torque difference between two propellers or two groups of propellers that are also used for the propulsion of the ship.

PA2—Speed and Load Control Device (Background Art)

The ship's Speed and Load Control Device has the purpose to keep the ship's engine speed and load within given operational range. Consequently, the ship's speed can also be maintained within a given range.

Figure 2:
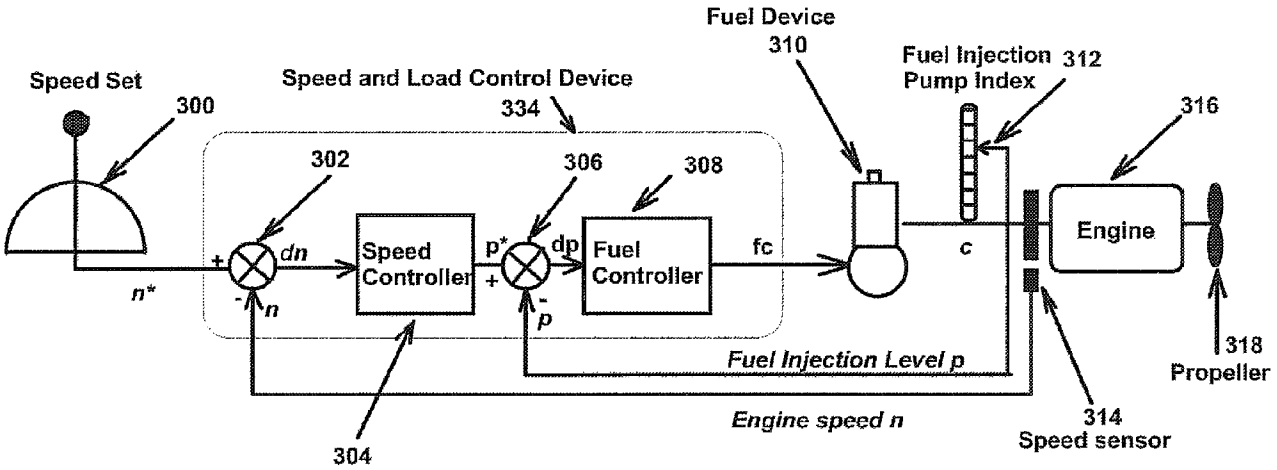
FIG. 2 Illustrates a typical configuration (background-art) of a ship's speed control with associated actuators and sensors FIG. 3 Illustrates schematically the configuration of a rolling averting and damping arrangement according to an exemplified embodiment FIG. 4 Illustrates a flow chart for the different method steps for roll damping and averting of a ship according to a preferred embodiment FIG. 5 Illustrates a ship's critical rolling when the roll averting and damping device is not active

FIG. 2 shows schematically the components of a traditional speed and load control device for a diesel engine & speed-set device 300 is used to set the required engine speed at a value n*. Typically an operator or an automated navigation system provides the speed set value. The actual speed of the engine n is read by a rotation speed sensor 314. The speed comparator 302 subtracts the rotation speed of the engine from the set speed. The resulting speed difference dn is applied to a Speed Controller 304. The output from the Speed Controller is the set-point p* to a Fuel Device 310. A fuel pump comparator 306 subtracts the actual fuel injection level p read by the Fuel Injection Pump Index Sensor 312 from the set-point value p*. The resulting difference dp is the input to the Fuel Controller 308 that manipulates the fuel device 310 via a power signal fc. The Fuel Device commands the fuel injection into the diesel engine 316 such that the engine speed n will be kept close to the set-point value n*. For most diesel engines the fuel device is a mechanical actuator while for a Common Rail Fuel system the fuel device is the Electronic Control Unit of the engine. Propulsion arrangements with diesel-electric engines work in the same fashion but with the difference that electrical generators and electrical motors are placed between the diesel engine and the propeller and it is the electrical motor that is speed-controlled.

DESCRIPTION OF PREFERRED EMBODIMENT

An arrangement and a method for averting and damping the roll of a propeller-driven vessel are hereby described according to a preferred embodiment. The method and the associated arrangement are supported by a mathematical formalism, described in the Algorithm section, that considers the physics involved in the rolling of a vessel.

Arrangement for the Preferred Embodiment

Figure 3:
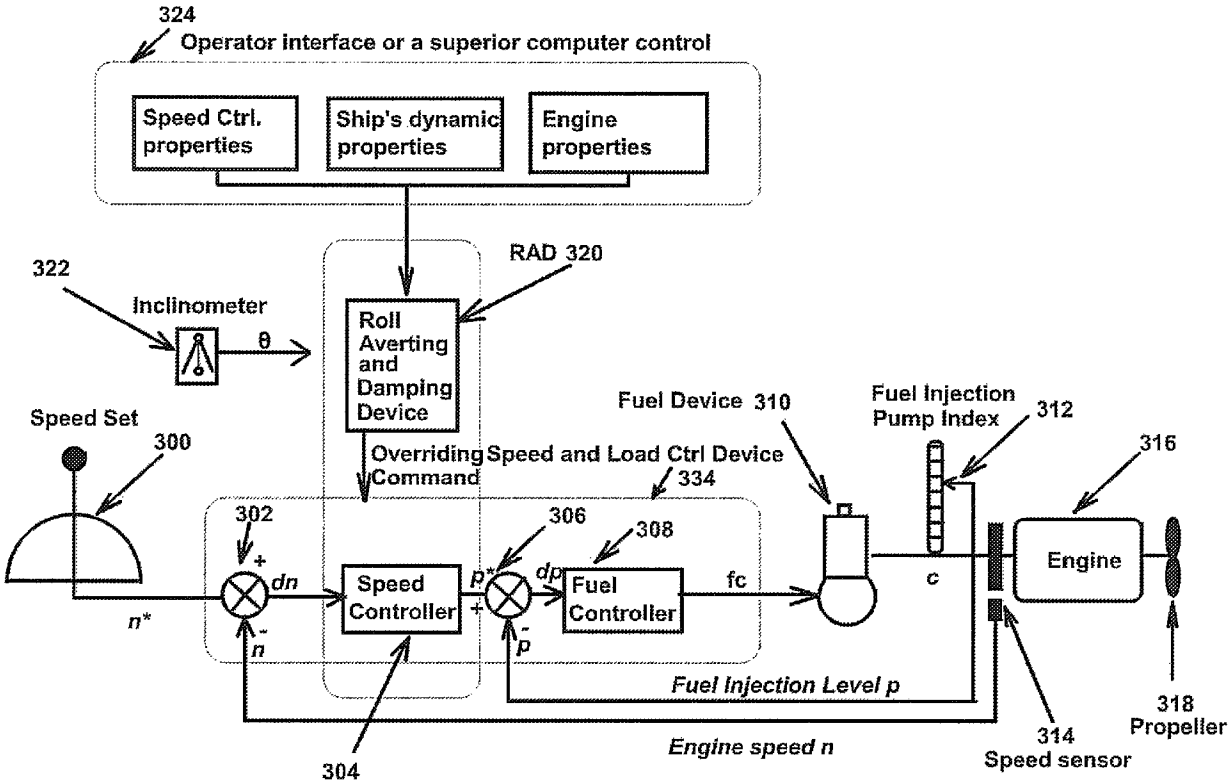

As disclosed in FIG. 3, the arrangement improves the prior art PA2 described earlier to incorporate additionally the roll averting and damping functionality.

A marine vessel may comprise a plurality of engines and propellers. For simplicity, only one engine and one propeller are described in this embodiment.

The arrangement according to this preferred embodiment essentially comprises the Roll Averting and Damping Device 320 (the RAD device) that can intervene with an overriding command to the Speed and Load Control Device 334 of the ship. Inputs to the RAD device comprises: (1) sampled signals from one or several sensors that are used to evaluate rolling properties of the ship and (2) information about technical and physical properties of different devices in the arrangement. The outputs from the RAD device are overriding commands and parameters to the Speed and Load Control Device 334 that alter the normal, prior art function of the said device 334. Overriding commands can be applied to any of the following subparts of the device 334: the Speed Comparator 302, the Speed Controller 304 or the Fuel Controller 308. All these subparts can achieve a change on the engine speed. In the preferred embodiment, the overriding commands are applied to the Speed Controller 304. Practically, the RAD device can be advantageously integrated with the Speed Controller 304.

In this preferred embodiment, the sensor used to determine rolling properties is an inclinometer 322 that gives the ship's current heel angle θ.

Information about ship properties is given via an operator's interface and/or via a superior computer 324. Properties of interest comprise ship's natural period Ts, transversal inertial moment Js and ship's rolling damping coefficient $\zeta_s$, Engine properties of interest comprise engine power Pe, nominal speed Nn, and the inertial moment of the engine Je. Properties of interest for the speed and load control device are the control amplification factor k and the time constants for the fuel device and controller Tc. In the preferred embodiment, this information is assumed known from technical specifications or from ship commissioning tests.

Alternative Arrangement Using System Identification Methods

The RAD device needs a dynamic model of the ship and values for parameters of this dynamic model as described in the preferred embodiment section. Ship dynamic models and parameter values can be determined by system identification methods, using sensor values. Control engineers skilled in the art are commonly using such methods.

Alternative Arrangements for Applying the Overriding Command to the Speed and Load Control Device In the preferred embodiment, the overriding command from the RAD device is applied to the Speed Controller 304. In an alternative embodiment a similar effect on the engine speed can be achieved by applying an overriding command to the Fuel Controller 308 or to the speed comparator 302. All these alternatives are essentially variations using the same disclosed principle of breaking a critical interaction between the speed control function of the engine and rolling, as described in the Algorithm section.

Method Steps

Figure 4:
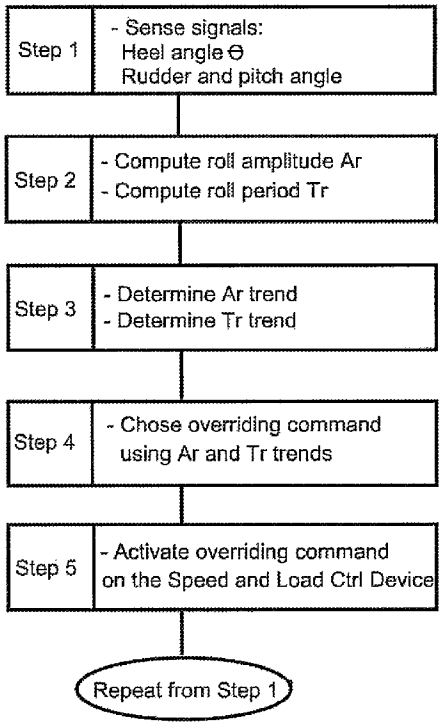

The method steps for the preferred embodiment disclosed in FIG. 4 are performed repeatedly at a constant time interval Tsample to ensure a relevant number of sensor readings for each rolling time period. An appropriate range for Tsample would be from tenths to hundreds of milliseconds. Typical rolling periods are 10 to 30 seconds.

Step 1.

The RAD device 320 is reading the inclinometer 322 to get the current heel angle of the ship θ. This value is stored in the RAD device and is available for further computations.

Step 2.

Using past heel angle readings, the RAD device determines the amplitude Ar and time period Tr of the ship's rolling. There are many known methods to determine the amplitude and period of the principal sine wave component of a sampled signal such as discrete Fourier transform, curve fitting or zero-crossing. In the preferred embodiment, a zero-crossing algorithm is proposed as follows: the RAD device uses a set of heel angle samples taken during a time interval equal to ship's natural period and determines the maximum past heel angle, Hmax, and the minimum past heel angle Hmin in the set of sampled values. The time interval between two consecutive zero-crossing heel angle changes is also measured as Tzero. Then the rolling amplitude Ar is computed as Ar=(Hmax−Hmin)/2 and the rolling period Tr as Tr=2*Tzero.

Step 3.

At this method step, the RAD device determines the trend of the rolling amplitude and rolling period over an interval Ttrend (the trend time). The magnitude of Ttrend depends on the type of the ship and on the speed precision requirement. An appropriate value is a small multiple of the ship's natural rolling period. For example if the ship's natural rolling period is Ts=20 seconds, then a proper range for Ttrend might be between 20 to 200 seconds. During the trend time, the ship undergoes several rolling periods whose amplitude and period trends are characterized as follows. The trend for the amplitude Ar is characterized as being one at the following categories: Low, Stochastic, Constant, Increasing or Decreasing. The trend for the rolling period Tr is characterized by being one of the following kinds: Stochastic, Constant or Natural. 'Stochastic' means that the roll period Tr, respectively the amplitude Ar are not regular. 'Constant' means a rolling time that is stable at a value that is different from the ship's natural rolling time. 'Natural' means that rolling has the rolling period value equal to the natural rolling time. 'Low' means that the amplitude of rolling is low. The trends described above are for the preferred embodiment. Alternative embodiments may have trend characterization different from the preferred embodiment, such as more types of intervals or a continuous range.

Step 4.

The RAD device 320 uses the trends determined at Step 3 together with the ship's dynamic properties and engine properties to determine an overriding command on the speed and load control device that is effectively averting and damping rolling and which also maintains the set speed of the ship. The prior art speed control algorithm that has no roll damping is denoted here as NS. As described further in the Algorithm section, the preferred embodiment defines two kinds of algorithms that are averting or damping ship's rolling: (1) constant speed (CS) and inverted control (IC). IC has a stronger roll reducing effect as compared to CS, so it might be applied for stronger rolling. The preferred embodiment discloses a set of rules for algorithm selection of the roll reducing and damping type as shown in Table 1. For example, as seen in the first line of the table, if the rolling amplitude is 'Low' or the speed error dn is large, then the rule NS (normal, prior art) speed control is applied. If the Roll Period is 'Constant' (second row) and the Roll Amplitude is 'Increase' (the fifth line), the stronger rule IC (inverted control) is applied to damp the increasing rolling.

TABLE 1

| | | Roll Period Tr | | |
|---|---|---|---|---|
| | | Stochastic | Constant | Natural |
| Roll Amplitude Ar | Low or dn = large | NS | NS | NS |
| | Stochastic | CS | CS | CS |
| | Constant | CS | CS | IC |
| | Decrease | CS | IC | IC |
| | Increase | CS | IC | IC |

If the Roll Period is stochastic (second column) and the amplitude has a decreasing trend (fourth line) then the CS constant speed algorithm is applied. The other cells of the table are interpreted in the same fashion, thus an appropriate roll damping and averting algorithm is selected for appropriate conditions. If rolling is persistent, e.g. due to sea conditions, then the CS and IS rules will be applied more often than NS. As a result, the propeller and hence the ship will not keep a constant, predefined speed. Thus the speed error dn will increase and after a time the rules in the first line of the table will trigger a normal speed control NS that will bring the speed to the predefined value. An alternative method is to trigger NS rules at constant time intervals to avoid large speed deviations.

Step 5.

At this method step, the RAD device 320 is activating the selected algorithm as an overriding command to the Speed and Load Control Device 334. This overriding command modifies the normal function of the speed controller to avert rolling.

Finally, the method steps are applied again at the next Tsample time starting from Step 1.

The steps described above might be varied in alternative embodiments as follows:

- A sensor may measure the heel angle θ and the first and second derivatives of θ at Step 1, such that Step 2 can make a more accurate evaluation of the rolling amplitude and rolling period.
- Step 1 and 2 can be merged using a sensor that gives directly the rolling period and amplitude.
- At Step 3 the rolling trend might be better predicted by using information on rudder position and ship's pitch angle.
- At Step 4, only one, two or several rolling averting and damping algorithms may be used.
- At step 4, depending on the ship's type and on roll damping preferences, other rule-based methods or continuous interval methods might be used in alternative embodiments as long as the roll averting principle described in the Algorithm section is followed.
- At Step 5, the overriding command can be applied with the same effect on the speed comparator 302, on the Speed Controller 304 or on the Fuel Controller 308. The preferred embodiment is to integrate the RAD device into the Speed Controller 304.

Algorithm

Ship rolling is a combined result of many forces such as:

The engine torque

The ship's hull interaction with the water

The propeller interaction with the water

The rudder interaction with the water stream

Same of the explanations that follow are for vessels with one propeller and some for vessels with two or several propellers. For vessels with several propellers and for azimuth propellers, it is assumed that each propeller has its own speed control system.

The speed controller determines the output torque of the engine. The torque increases or decreases depending on (a) the ship's speed, (b) the rotation speed of the propeller, (c) variations of the ship's heel angle, (d) rudder interaction with the water stream produced by the propeller, (e) changes in ship's yaw angle and (f) interaction between waves and hull.

The below described phenomena, individual or combined are contributing to the development of critical rolling that can be described as a correlation between controller dynamics, ship's specific rolling period and wave dynamics. The condition is a driven harmonic oscillation.

(F1) Direct Reactive Moment Effects of the Propeller-Engine Unit on the Ship's Hull The torque from the engine is converted mainly to a longitudinal thrust; however a small portion is creating a moment and reaction moment between the propeller and the surrounding water. This torque is transferred from the propeller to the ship's hull. The torque is proportional to the engine power. Higher ship speed means a higher torque on the propeller, by a near quadratic relation.

(F2) Propeller-Created Longitudinal Moment

When the ship is heeling the propeller becomes located offside from the ship's centerline. This gives the propeller trust a moment arm that turns the ship in the same direction as the heel. Thus, while rolling, the ship will have successively a port to starboard and starboard to port-curved trajectory.

(F3) Moment Created by Uneven Flow of Water Around a Heeled Hull

For a ship having zero heel angle, the water flows symmetrically on both the STB and Port side. A heeled ship has an uneven flow of water around the hull. According to the Bernoulli principle, the pressures on the STB and Port side will be different. An inclined ship has hydrodynamic properties that are inferior compared to a ship on even keel. The result is more drag causing the ship's speed to decrease and the propeller torque to increase. The speed sensor 314 registers a reduction in RPM. The speed controller 304 will increase the moment on the engine to restore the speed. This will increase the uneven water flow such that the ship will tend to change heading. This will further increase the heel angle sensed by the inclinometer 322 and consequently the moment on the engine will increase again, in a continuous process until equilibrium is reached via compensating restore and friction moments. The moment of the engine will increase non-linearly with the heel angle. This non-linearity, described by a near quadratic function, will maintain a self-sustained rolling. This effect appears for both single and multi-propeller ships.

(F4) Hull Movement Effect on Propeller-Water Interaction

The literature on ship handling describes a number of effects creating aft lateral movements due to uneven flow of water through the propeller blades: following wake effect, inclination effect and helical discharge effect. These effects follow from differences in water flow through the STB and Port side of a ship's propeller. Aft lateral movement is creating a heading change, which creates a transversal centripetal force that increases the heel angle. These effects appear only for a single propeller ship.

(F5) Hull Inclination Affects on Propeller-Water Interactions

Rolling moment created by the changes in heading (turning) of a ship. A ship with mass m that has a linear speed v, has a kinetic, energy expressed by $E_k=mv^2/2$. A ship can make a turn due to a rudder movement or due to one of the effects described above. During such a turn, a lateral centripetal force heels the ship. A part of the kinetic energy is thus transformed into the energy that is rolling the ship.

(F6) Wave Excitation Forces

The vessel dynamics in calm water is different compared to a rough sea condition when the attack angle of the wave on the ship's hull must be taken into consideration.

In calm water conditions, the engine-propeller unit has a steady rotational speed. The rudder is in mid position and the torque lists the vessel, opposite to the direction of the propeller rotation. Depending on the vessel size, weight and the water flow relative to hull, the list angle is typically in the range 0.5-2 degrees. The angular velocity of the heel angle is zero.

In rough sea condition or swell waves, the reaction of the ship and of the engine speed control is different due to the dynamic effect from the waves on the hull. Waves are bouncing and heeling the ship. When the ship heels, the resistance in water becomes higher, the ship tends to turn as described above in (F3) and (F5), and the rudder is deflected to compensate the emerging turn. All these three processes cause drag and is slowing down the ship. Thus the engine power increases as the roll angle increases.

Furthermore, the hull transverse angle and angular velocity increases or decreases the engine load:

The engine load increases when the ship is rolling from port to starboard (when the propeller is turning in clockwise direction).

The engine load reduces when the ship is rolling from starboard to port.

This variation is superimposed on the load variation originating from the ship's speed variation. The rotation speed and load of the engine, hence the torque, become variable. The variation of load causes the engine speed controller to increase or decrease the fuel index 312 to maintain the required rotational speed.

(F7) Rudder Forces

The attacking waves lead to a heading error. The heading controller of the autopilot then changes the rudder position to correct the heading error. Corrections done by the heading control system can also increase or decrease the heel angle and thus the engine load.

(F8) Critical Interaction Between Ship's Rolling and the Speed Control Function

Next, we show quantitatively that the speed control of a ship, under certain conditions, will generate and maintain the rolling of the ship. This interaction is critical since part of the propulsion energy of the ship is converted to rolling. The rolling of propulsion driven ships can be determined by solving a system of equations modelling the heel angle dynamics as the interaction between speed control, engine torque and ship's inertial forces. One such possible system of differential equation for the preferred embodiment is:

$$\ddot{\phi} = 2\omega_s(k-\varsigma)\dot{\phi} - \left(\omega_s^2 - \omega_w^2\cos\left(2\pi\frac{t}{T_w}\right)\right)\phi \quad \text{(E1)}$$

$$k = \frac{1}{T_c}(-k + A_c\phi^2) \quad \text{(E2)}$$

Equation (E1) can be written equivalently with explicit terms as:

$$\ddot{\phi} = 2\omega_s k\dot{\phi} - 2\omega_s\varsigma\dot{\phi} - \omega_s^2\phi + \omega_w^2\cos\left(2\pi\frac{t}{T_w}\right)\phi$$

E1 consists of the following terms:

T1. $\ddot{\phi}$ is the second derivative of the heel angle, i.e. heel angle acceleration T2. $-2\zeta\omega_x\dot{\phi}$ is a damping factor that depends on hull's shape and condition, where $\zeta$ is a damping constant specific for a ship's design and hull condition, $\omega_s$ is the heel angle speed corresponding to the natural frequency period of the ship scaled by the ship's moment of inertia, and $\dot{\phi}$ is the roll angle velocity.

Figure 1:
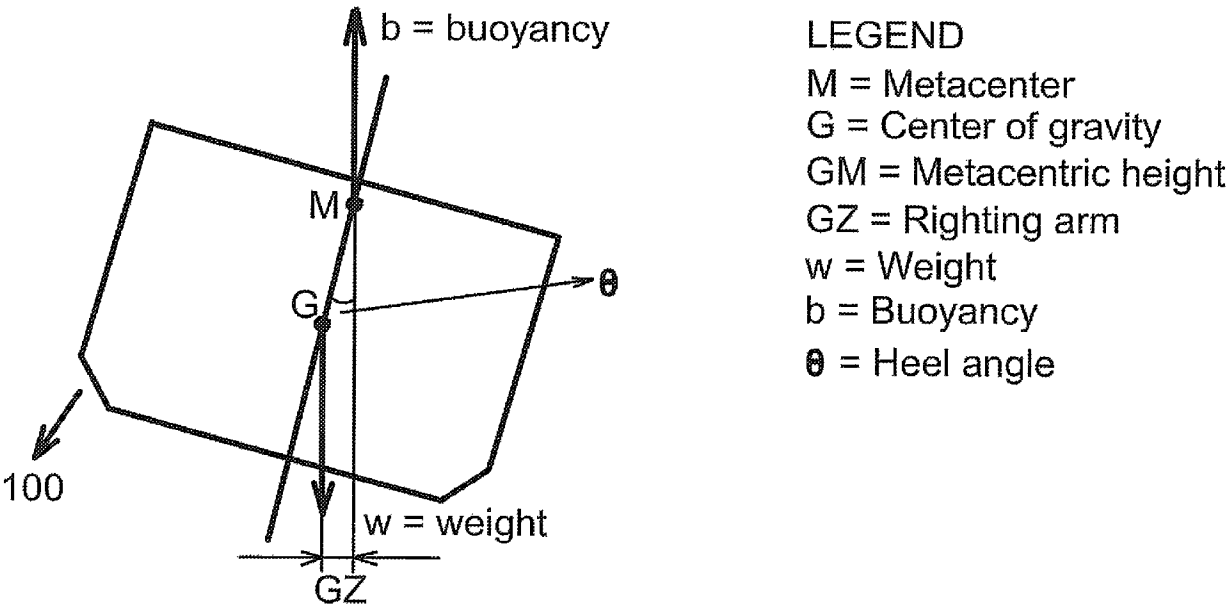
FIG. 1 Illustrates restoring forces and the restore moment of a tilted ship

T3. $-\omega_s^2\phi$ is the righting arm restore moment that gives ship's stability (see FIG. 1)

T4. $2\omega_s k\dot{\phi}$ is a factor that heels the ship via the speed control and resulting engine-propeller moment. The dynamics of this moment depends on the variation of the factor k of the engine speed and load control device 334, which is determined by the amplification and time constant of the engine 316, speed controller 304, Fuel Controller 308 and Fuel device 310. This variation is modelled by the differential equation $$\dot{k} = \frac{1}{T_c}(-k + A_c\phi^2) \quad \text{(E2)}$$

which expresses the delay and magnitude of a speed control action. In this equation, $T_c$ is the time constant of the controller together with the engine actuation and $A_c$ is the maximum amplification factor of the controller. Both $T_c$ and $A_c$ are parameters that can be adjusted for a typical speed controller 304. In (E2) the quadratic factor $\phi^1$ expresses the non-linear relation between the engine moment and the heel angle.

T5.

$$\omega_w^2\cos\left(2\pi\frac{t}{T_w}\right)\phi$$

is a factor that describes the influence of waves. $T_w$ is the period of the waves and $\omega_w$ is the amplitude of the waves scaled by the ship's moment of inertia. For the RAD device this factor acts as a disturbance. For an alternative embodiment, wave parameters may be identified, measured or obtained from commercial marine wave and wind forecast sources.

If the influence described by the term T4 and/or T5 is larger than the damping part of the equation, then the ship's rolling will be maintained and amplified. Practically this is often the case with modern ships that have strong engines and/or cargo ships that have small restore arms.

Under particular conditions, the equation (E1) becomes a Mathieu equation or a Van der Pol equation. Both have oscillating solutions under certain conditions. If waves are not present then $\omega_w=0$, and if the control device 334 has constant time effects, $\dot{k}=0$, then $k=T_cA_c\phi^2$ and equation (E1) reduces to the Van der Pol equation $\ddot{\phi}=2\omega_s(T_cA_c\phi^2-\zeta)\dot{\phi}-\omega_5^2\phi$ that is known to generate critical oscillations.

If in (E1) $k=\zeta$ and in (E2) $\dot{k}=0$, then (E1) is an equation of type Mathieu:

$$\ddot{\phi}+\left(\omega_s^2-\omega_w^2\cos\left(2\pi\frac{t}{T_w}\right)\right)\phi=0$$

that is known to give critical oscillations when parameters are in certain relations to each other.

The core of the proposed roll averting and damping method is avoiding the build-up of rolling by manipulating the speed control parameters appearing on the right side of the differential equation such that the heel angle acceleration, speed and value is effectively reduced. In the absence of energy input from the engine, rolling will dampen quickly due to the restoring moment and due to friction forces between the ship's hull and the water. The resulting reduction in propeller torque variation means less propeller slip and less fuel consumption.

The proposed method comprises, but is not limited to one of the following alternatives:

M1. Increasing the response time Tc of the speed controller of the engine. This decreases the term T4 and the rolling ceases to be maintained by the ship's engine.

M2. Reducing the amplification of the controller to a value that does not create critical oscillations.

M3. Generating engine speed alterations triggered at appropriate time instances such that the term (T4) is counteracting heel angle variations. This means a control action with inverted sign.

M4. Any other speed control method that decreases heel angle variation. One such method, known to control engineers skilled in the art, is using a model of the ship's dynamics to compute a speed control function that minimizes the integral of the heel angle over a rolling period. This is the so-called model-predictive control method.

M5. Any equivalent method that minimizes the integral of heel angle variations by controlling any of the parameters of the Speed and Load Control device.

The preferred embodiment described by the method steps shown in FIG. 4, discloses two roll damping and reducing methods: the constant speed algorithm (CS) that can be implemented by the methods M1 or M2 described above and the inverted control (IC) that can be implemented as algorithm M3, M4 or M5.

The methods described above for reducing the non-linear term are associated to disturbances in the ship's speed and ship's heading that must be compensated. Thus the proposed method includes also the appropriate compensations of ship's speed as described in the Method Steps section.

All presented alternative embodiments are essentially variations and modifications using the same disclosed roll averting and damping principle without departing from the scope of the present invention as defined in the appended Claims.

The rolling averting and damping principle disclosed in this application is fundamentally different from the Dow U.S. Pat. No. 1,731,236, described in the prior-art section (P1). The said patent and other similar anti-rolling patents focus on just a novel anti-rolling actuator—the propeller—unknown for this function prior to the 1930s. By contrast, our proposed method and device recognizes the fact that a propeller torque variation during rolling is sensed as a change in ship's speed and thus the speed control function is actually maintaining and amplifying ship rolling by a recurring process. Our proposed method is deflecting the critical rolling behavior by breaking the critical interaction between the propeller torque and the ship's speed control function.

The same argument applies for the patent applications PA0423901A1 and US20080183341A1 described in prior art section (P1). The said patents are proposing special active anti-rolling actuators (water jets respectively counter-rotating propellers) that inject energy into the body of the ship, thus the rolling energy of the ship is compensated and rolling is reduced. These methods are increasing the fuel consumption of the ship. By contrast, bur method avoids the critical situation when the engine-propeller unit increases rolling. The said methods act after rolling has occurred, our proposed method act to avoid rolling before high amplitude rolling is produced. The controller units of the said patents act on the proposed actuators, controlling their energy to counteract rolling. Our proposed method acts on the speed controller and prevents the actuator from releasing energy that would increase rolling. Our proposed method, by avoiding use of energy for rolling, reduces ship's fuel consumption.

EXAMPLES

Example 1

Figure 5:
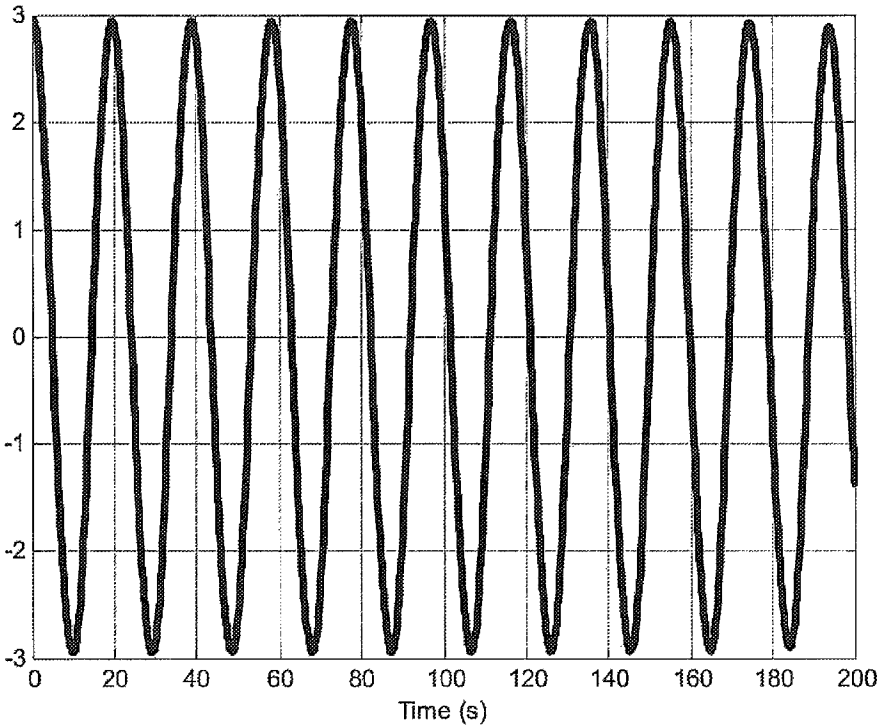

FIG. 5 shows a critical rolling of ship according to equations (E1) and (E2) when the roll damping and avoiding device (RAD) is not acting. The vertical coordinate is heel angle (in degrees) and the horizontal coordinate is time (in seconds). The natural rolling period is 20 seconds and the Speed and Load Control Device delay is 1 second. The amplification factor of the speed controller is 80, a high value that is maintaining a critical rolling.

Example 2

Figure 6:
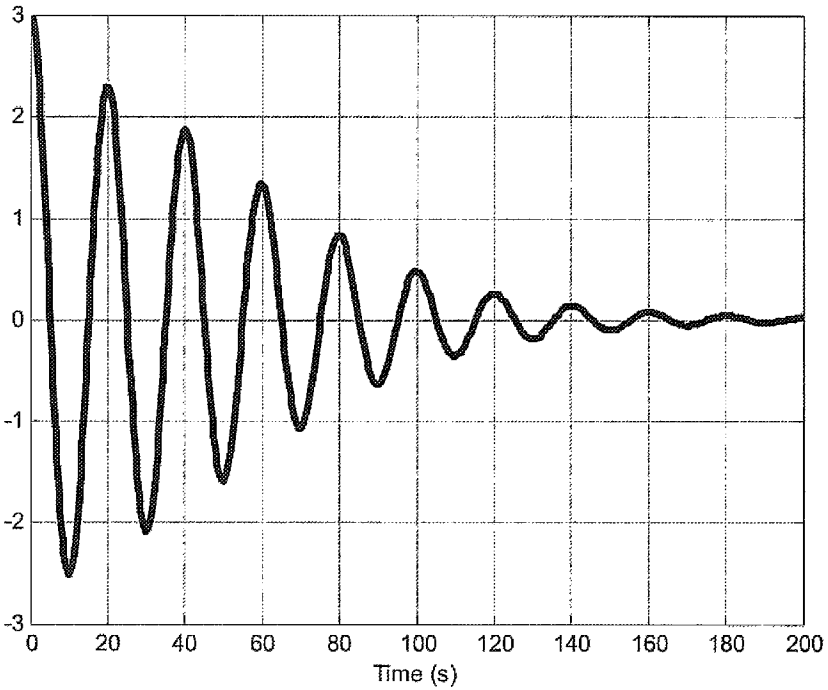
FIGS. 6, 7, 8, 9, 10 illustrate examples of roll damping responses according to various exemplifying embodiments of the roll averting and damping principle

FIG. 6 shows the effect of enabling the low amplification algorithm variant M2, for the same ship parameters as in Example 1. The selected algorithm is by decreasing the amplification from 80 to 75. It can be seen that rolling is still present, but damped in about 9 cycles.

Example 3

Figure 7:
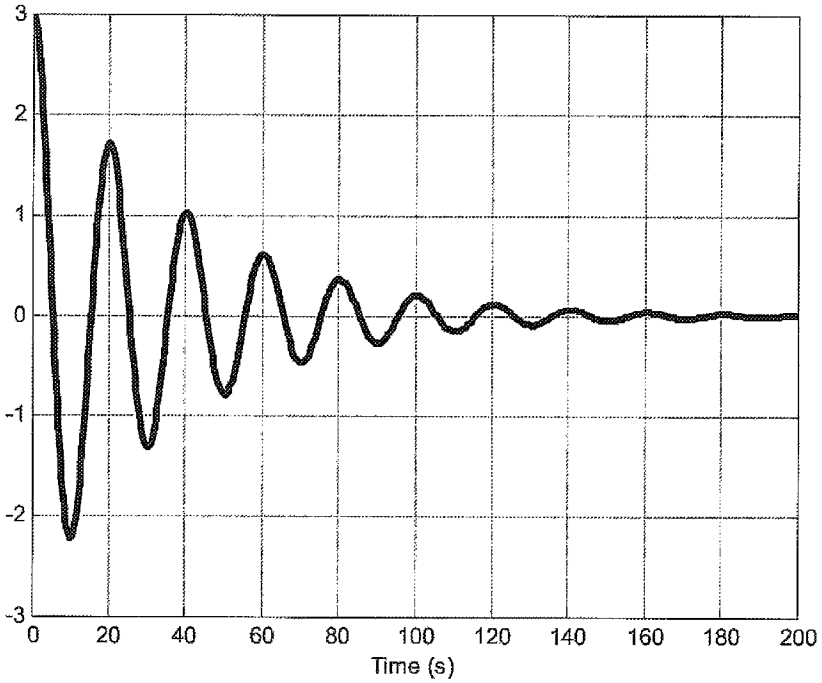

FIG. 7 shows the effect of enabling the variant of the method CS by the algorithm M1, for the same ship parameters as in Example 1. The time delay of the speed controller is increased from 1 second to 50 seconds and the amplification is again 80 corresponding to the critical rolling. It can be seen that the effect is stronger damping compared to the case in Example 2, the rolling being damped in about 7 cycles. The speed control will be more affected as compared to the case in Example 2 since the speed control will not act for 50 seconds.

Example 4

Figure 8:
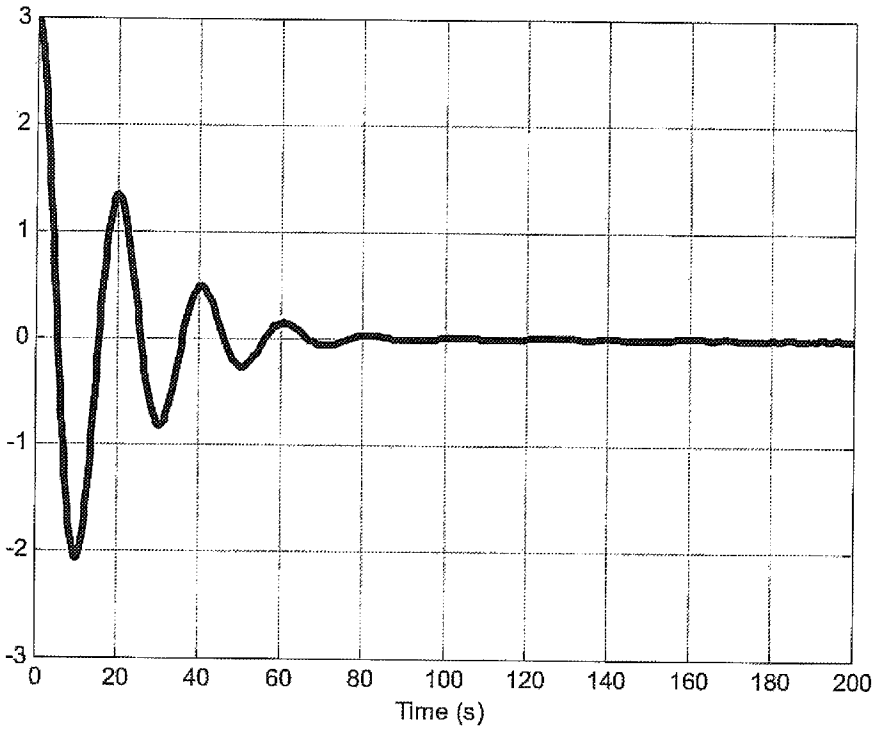

FIG. 8 shows the effect of enabling the variant of the constant speed method CS by the algorithm M3, for the same ship parameters as in Example 1. The time delay of the speed controller is again 1 seconds but the amplification is now −50, i.e. inverted control. It can be seen that the effect is a stronger damping compared to the case in Example 3, the rolling being averted in about 4 cycles at the price of a possible larger speed control error for a time interval of 80 seconds.

Example 5

Figure 9:
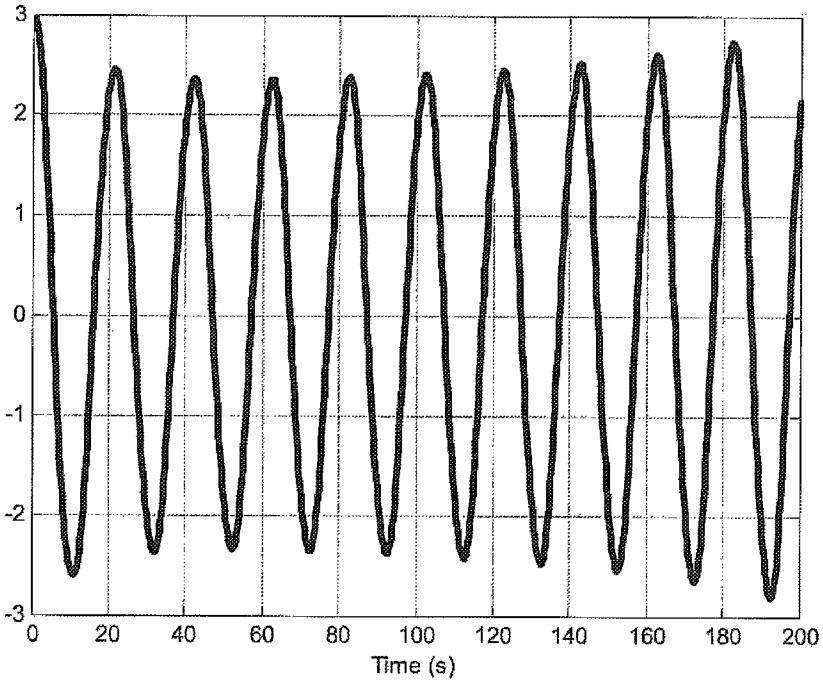

FIG. 9 shows a critical rolling of type parametric rolling obtained from equation (E1) when waves are characterized by Kw=56 and Tw=Ts/2=10 seconds. The speed controller parameters are the same as in Example 1.

Example 6

Figure 10:
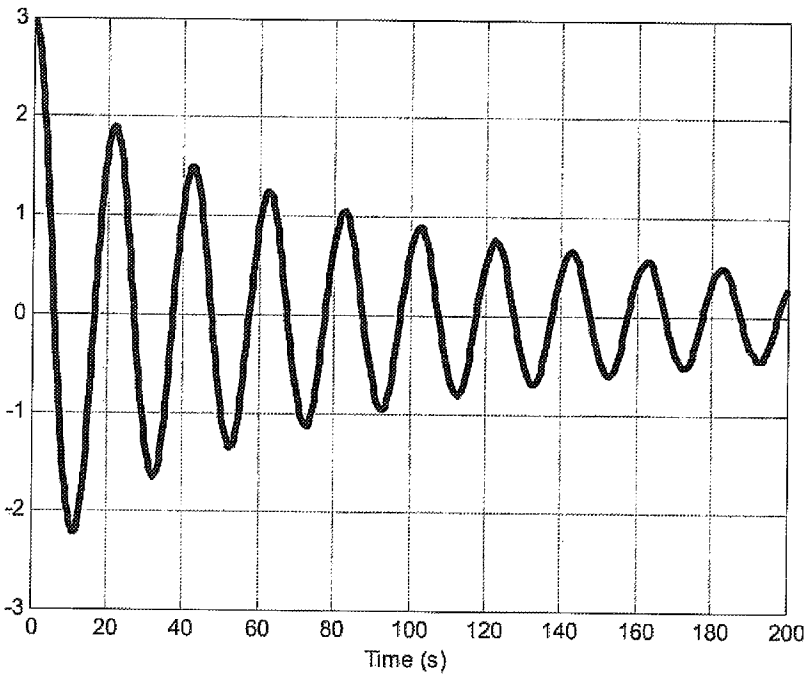

FIG. 10 shows a damping effect for the parametric rolling shown in Example 5. The algorithm is inverse control (IC), using an amplification factor of −30. The damping is not that strong, however, parametric rolling is dangerous for ship safety and there are no effective damping methods available. Thus any obtained damping is valuable.

The invention claimed is:

1. A method for averting and damping rolling of a marine ship with propeller propulsion, wherein the current heel angle of the ship is sensed and a sequence of said sensed heel angles is used to compute values that characterize the behavior of ship's rolling comprising rolling amplitude, rolling period and trends of the rolling amplitude and rolling period, a model is used to characterize the behavior of ship's rolling as a critical interaction between the ship's dynamics and the ship's engine/propeller speed controller, said critical interaction increases or maintains the rolling of the ship, signals that are related to the ship's rolling, including their derivatives of first and second order, and parameters that effect ship's rolling, characterize together the ship's dynamics and are used in the said model, and a selection of a proper control algorithm is done, based on said ship's rolling model and on said rolling trend data to avert and damp said critical interaction between the ship's dynamics and the engine/propeller speed controller by modifying the function of the engine/propeller speed regulator such that said critical interaction is counteracted.

2. Method, according to claim 1, wherein averting and damping of said critical interaction is done by predicting the forthcoming variations of the heel angle using wave encounter values, wind angles and ship heading angles obtained from either previous measurements or from generally available marine information sources such as weather reports, wave and wind reports and satellite positioning systems.

3. Method according to claim 2, wherein said control algorithm increases the response time of the engine/propeller speed controller, hence propeller speed changes occur slower than the ship's rolling period and thus the ship's heel angle is not affected by engine load variations, averting in this way said critical interaction.

4. Method according to claim 3, wherein the speed variations of the ship are compensated by interleaving engine/speed control with said control algorithm.

5. Method according to claim 2, wherein said control algorithm reduces the amplification of the engine/propeller speed controller or alternatively inverts the sign of this amplification, in effect reducing or countering ship's engine load variations caused by rolling, decreasing or damping in this way said critical interaction.

6. Method according to claim 5, wherein the speed variations of the ship are compensated by interleaving engine/speed control with said control algorithm.

7. Method according to claim 2, wherein the speed variations of the ship are compensated by interleaving engine/speed control with said control algorithm.

8. Method according to claim 1, wherein said control algorithm increases the response time of the engine/propeller speed controller, hence propeller speed changes occur slower than the ship's rolling period and thus the ship's heel angle is not affected by engine load variations, averting in this way said critical interaction.

9. Method according to claim 8, wherein the speed variations of the ship are compensated by interleaving engine/speed control with said control algorithm.

10. Method according to claim 1, wherein said control algorithm reduces the amplification of the engine/propeller speed controller or alternatively inverts the sign of this amplification, in effect reducing or countering ship's engine load variations caused by rolling, decreasing or damping in this way said critical interaction.

11. Method according to claim 10, wherein the speed variations of the ship are compensated by interleaving engine/speed control with said control algorithm.

12. Method according to claim 1, wherein the speed variations of the ship are compensated by interleaving engine/speed control with said control algorithm.

13. Method according to claim 12, wherein the speed variations of the ship are compensated by interleaving engine/speed control with said control algorithm.

14. Method according to claim 1, wherein the method is executed by a computer program comprising computer program codes carrying out the method steps.

15. Method of claim 14, additionally comprising non-transitory computer readable medium comprising at least part of the computer program.

16. Method of claim 15, additionally comprising a device arranged to interpret the non-transitory computer readable medium.

17. Method according to claim 16, wherein the speed variations of the ship are compensated by interleaving engine/speed control with said control algorithm.

18. Method according to claim 15, wherein the speed variations of the ship are compensated by interleaving engine/speed control with said control algorithm.

19. Method according to claim 14, wherein the speed variations of the ship are compensated by interleaving engine/speed control with said control algorithm.

* * * * *